US007306219B2

(12) United States Patent
Keil et al.

(10) Patent No.: US 7,306,219 B2
(45) Date of Patent: Dec. 11, 2007

(54) DEVICE FOR REVERSAL OF DIRECTION OF PLANAR LETTERS

(75) Inventors: Goeran Keil, Schoenefeld (DE); Armin Zimmermann, Constance (DE)

(73) Assignee: Siemens AG, München (DE)

( * ) Notice: Subject to any disclaimer, the term of this patent is extended or adjusted under 35 U.S.C. 154(b) by 0 days.

(21) Appl. No.: 11/597,763

(22) PCT Filed: Apr. 20, 2005

(86) PCT No.: PCT/EP2005/004216

§ 371 (c)(1),
(2), (4) Date: Nov. 27, 2006

(87) PCT Pub. No.: WO2005/115892

PCT Pub. Date: Dec. 8, 2005

(65) Prior Publication Data

US 2007/0215438 A1 Sep. 20, 2007

(30) Foreign Application Priority Data

May 29, 2004 (DE) ..... 10 2004 026 362

(51) Int. Cl.
*B65H 15/00* (2006.01)
*B65H 29/60* (2006.01)

(52) U.S. Cl. ..... 271/225; 271/185; 271/227; 271/902

(58) Field of Classification Search ..... 271/184, 271/185, 225, 227, 902, 3.19; 198/575, 577, 198/580, 620
See application file for complete search history.

(56) References Cited

U.S. PATENT DOCUMENTS

| | | | | |
|---|---|---|---|---|
| 3,273,886 | A * | 9/1966 | Taylor, Jr. | 271/225 |
| 3,885,664 | A * | 5/1975 | Fujimura | 198/572 |
| 4,693,464 | A * | 9/1987 | Honma | 271/265.02 |
| 5,415,391 | A * | 5/1995 | Wong et al. | 271/225 |
| 5,449,166 | A * | 9/1995 | Lohmann et al. | 271/225 |
| 5,720,478 | A * | 2/1998 | Carter et al. | 271/186 |
| 6,176,485 | B1 | 1/2001 | Wingate | |
| 6,244,591 | B1 * | 6/2001 | Paulat | 271/225 |
| 6,402,133 | B1 * | 6/2002 | Miyake | 271/3.19 |
| 6,550,621 | B2 | 4/2003 | Fukatsu et al. | |
| 6,702,284 | B2 * | 3/2004 | Sette et al. | 271/291 |
| 7,080,834 | B2 * | 7/2006 | Asari | 271/176 |

FOREIGN PATENT DOCUMENTS

| | | |
|---|---|---|
| EP | 1 295 826 A2 | 3/2003 |
| JP | 61064658 A | 4/1986 |

* cited by examiner

*Primary Examiner*—Douglas A Hess

(57) ABSTRACT

A device for reversal of direction of planar letters has two cover band conveyor runs with reversible transport direction, driven by a common drive roller. The letters are distributed alternately on the cover band conveyor runs. The back-transported letters are led into removing cover band transport means. The drive roller is controlled such that on introduction of a following letter into a cover band conveyor run the preceding back-transported letter has already accelerated to the nominal speed, the braking process only being initiated when the rear edge of the relevant letter has left the introducing cover band transport run and the preceding letter is no longer held in one of the controlled and reversible cover band conveyor runs.

9 Claims, 5 Drawing Sheets

DEVICE FOR REVERSAL OF DIRECTION OF PLANAR LETTERS

BACKGROUND OF THE INVENTION

The invention relates to a device for reversal of direction of planar letters in letter sorting systems with cover band conveyors for introducing and removing letters.

In letter sorting systems in which planar letters are fed to units such as readers and printing equipment, in order to sort letters according to sorting information appended to their surface, this sorting information must be located at defined positions. If it is not, the letters must be brought into the working position by turning them around their longitudinal or vertical axis.

To this end a device for reversing the direction (the front edge becomes the rear edge after the re-insertion into the flow of letters) is known (DE 43 45 160 C2). A collision-free reversal of two letters following each other however requires the first letter to be reversed to have already left the device before the second letter enters it. With the usual high conveyance speeds this would lead to impermissibly large minimum gaps between consecutive letters. By using two reversing devices it is however possible to reverse even consecutive letters with small gaps. In this case the letters are fed alternately into one of the two reversing devices. In the device each letter to be reversed is stopped and travels backwards again out of the device.

Corresponding compact-design devices for reversing the direction of planar letters with two reversing devices are known from U.S. Pat. No. 6,550,621 B1.

SUMMARY OF THE INVENTION

The object underlying the invention is to create a simple device for reversing the direction of planar letters in letter sorting systems with cover band conveyors for introducing and removing the letters, with which a collision-free rotation around their vertical axis of planar letters following each other with a small gap between them is possible.

Accordingly, in one embodiment, the introducing cover band conveyor means, having two endless circulating belts, between which the letters are transported clamped one after the other, is followed by a junction for splitting up the letters alternately onto two cover band transport runs running at an acute angle away from each other, which are followed by a controlled and reversible conveyor run in each case in which the letters are also transported clamped. Both conveyor runs are driven by a drive roller arranged between them and the letters are guided around the drive roller at such an enfolding angle that the letters are braked and accelerated almost without slipping, taking into account the frictional forces. Each conveyor run is embodied so that it directs the letters on reverse transport at an acute angle to the relevant introducing cover band transport run into a removing cover band transport means with two endless circulating belts. The braking process is only started when the rear edge of the relevant letter has left the cover band transport run. At all times the letters are carried in the device by frictional force.

It is thus possible to process flows of letters with small gaps between the letters with only one device for reversing the direction.

To feed the letters back into the flow the two cover band transport means removing the letters during back transport are advantageously routed to one confluence with one output.

In order to guarantee that letters with no reversing can also pass through the device without hindrance, it is advantageous to arrange the ends of the controlled and reversibly-driven conveyor runs far enough away from each other for letters to be transported onwards with no reversal to be able to be transported without hindrance to a subsequent third removal cover band transport means.

For simple embodiment of the controlled and reversibly-driven conveyor runs it is advantageous for these each to consist of an outer endless cover belt which is guided over two deflection rollers, and a common inner cover belt which is guided over the drive roller and a further deflection roller.

A further option for simple embodiment of the controlled and reversibly-driven conveyor runs, but with a restricted range of letter formats, consists of providing an outer endless cover band which is guided over two deflection rollers and the common drive roller.

To remedy these restrictions in the range of letter formats it is advantageous, for clamping the letters in the two conveyor runs, to provide a further non-driven pressure roller.

It is also advantageous in each case to provide as the outer belt of each cover band transport run following the junction, and as the inner endless belt of the assigned cover band transport means removing the letters during back transport, only one driven circulating endless belt guided by rollers. This allows one driven endless circulating belt to be saved.

It is also advantageous to use a light barrier as a detection means for the rear edges of the letters.

The invention is explained below in an exemplary embodiment with reference to the drawings.

BRIEF DESCRIPTION OF THE SEVERAL VIEWS OF THE DRAWINGS

These show

DETAILED DESCRIPTION OF THE INVENTION

Figure 1:
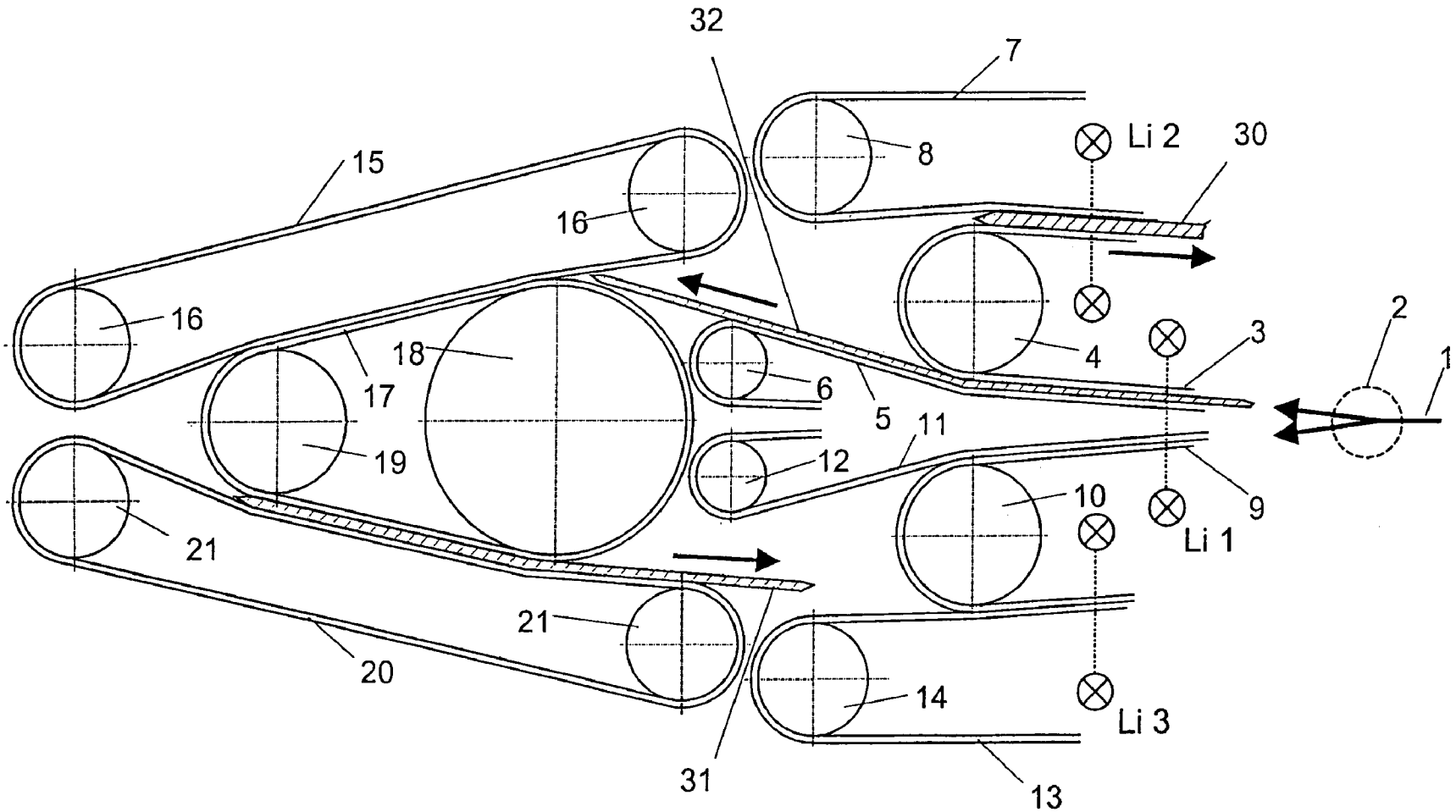
FIG. 1 a schematic overhead view of the device for direction reversal.

The planar letters 30, 31, 32 are directed via a cover band conveyor means 1 not shown in detail here and a controllable junction 2 alternately onto two introducing cover band transport means diverging from each other at an acute angle. The right-hand cover band transport run consists of a first endless belt 3, which is deflected via a first deflection roller 4 and brought back, and a second endless belt which is deflected via a second deflection roller 6 and brought back. Accordingly the left-hand cover band transport run likewise consists of a third endless belt 9, which is deflected via a third deflection roller 10 and brought back, and a fourth endless belt 11 which is deflected via a fourth deflection roller 12 and brought back.

Each cover band transport run directs the letters into a controlled and reversibly-driven conveyor run. Both conveyor runs converge in the inflow direction at acute angle. The conveyor run following the right-hand cover band transport run consists of a fifth, outer endless belt 15 which is deflected via two deflection rollers 16 and a sixth, inner endless belt which runs over a larger drive roller 18 and a smaller deflection roller 19. Opposite this endless belt 17 is simultaneously the inner endless belt of the conveyor run following the left-hand cover band transport run which features a seventh outer belt 20 which is deflected via two deflection rollers 21.

The deflection rollers 16, 21 of the conveyor runs positioned close to one another are at such a distance from one another that the thickest letters 30, 31, 32 which do not have to be transported back or which are longer than the reversible conveyor run, can be fed unhindered to a following means of transport by virtue of the gap between the deflection rollers 16, 21. Since the directions of transport of the cover band transport runs and the subsequent conveyor runs in each case are inclined towards one another, a necessary enfolding angle is produced, with which the letters 30, 31, 32 are carried around the drive drum 18.

Since the conveyor runs are inclined inwards, the letters 30, 31, 32 are directed during back transport outwards past the introducing cover band transport runs and the introducing cover band conveyor means 1 on both sides into removal cover band transport means. These each consist of outer endless belts 7, 13 diverted via diversion drums 8, 14 and inner belts 3, 9, which are simultaneously the outer belts of the introducing cover band transport runs.

The fact that the letters 30, 31, 32 are separated alternately onto the introducing cover band transport runs and thereby are fed alternately on the opposite sides of the drive drum 18 into the reversible conveyor runs means that it is no longer necessary as it was previously to move the previous letter 31 out of the reversing conveyor run before the subsequent letter 32 moves into this run. It is only necessary for the drive drum 18 to have reached its rated speed when the letter 32 travels into the reversing conveyor run at just this rated speed and the braking process is only started as soon as the rear edge of the letter 32 traveling into the reversible conveyor run has left the introducing cover band transport run and the previous letter 31 has left the reversible conveyor run. This makes it possible, despite the braking and acceleration processes, to implement small gaps between the reversed letters 30, 31, 32 with only one drive drum 18. When the front and rear edges of the letters 30, 31, 32 have reached the described positions, they are determined by means of light barriers Li1 to Li3 and the run timing.

The timing sequence is illustrated with reference to FIGS. 2*a-d*.

Figure 2A:
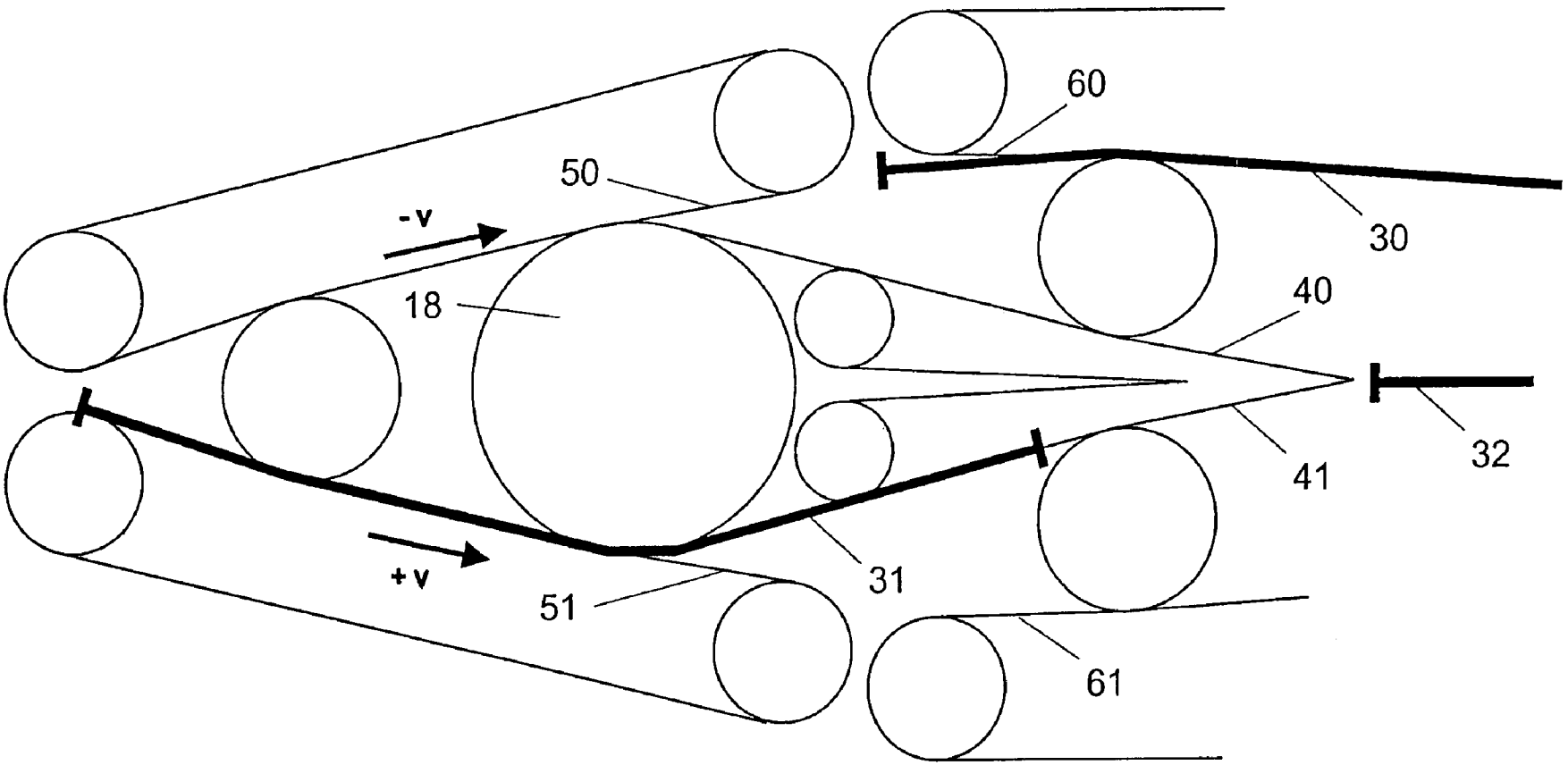
FIG. 2*a-d* highly schematic overhead views of the device for direction reversal at different consecutive points in time.
Figure 2B:
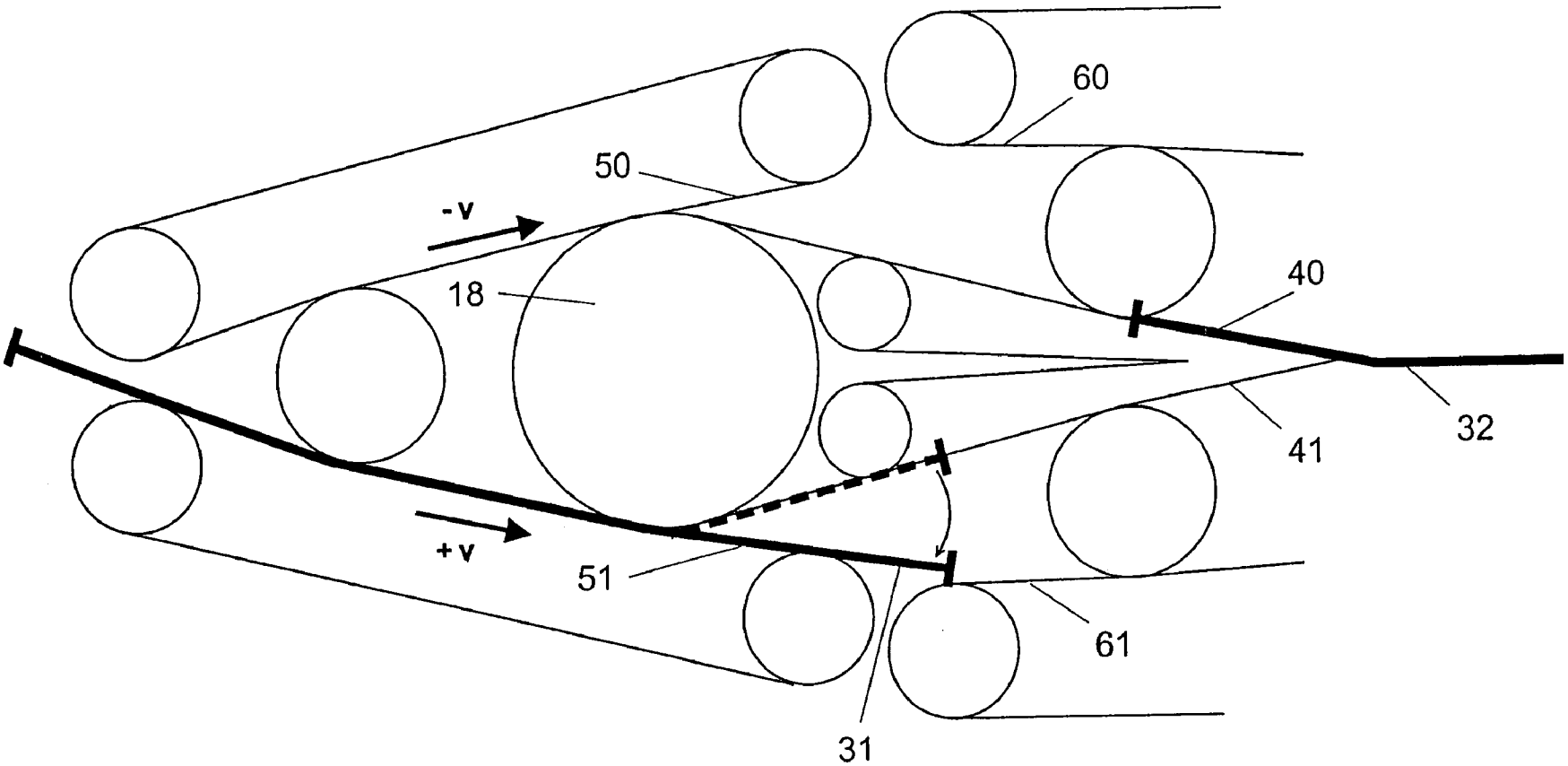

In FIG. 2*a* the first letter 30 of the incoming flow of letters has left the upper or in the incoming direction right-hand conveyor run 50 and is transported reversed by the associated removal cover band transport means 60 at its rated speed. Simultaneously the subsequent second letter 31 travels once again at rated speed into the conveyor run 51 from the other side and starts to be braked at the point in time shown, at which the rear edge has just left the assigned cover band transport run 41. In FIG. 2*b* the second letter 31 has come to a stop, its rear edge is, because of the inherent stiffness of the letter 31, is tilted as shown in the direction of the associated removing cover band transport system 61 and the drive drum 18 is started reversed, so that the second letter 31 is transported into the cover band transport means 61. Simultaneously the third letter 32 is transported alternately in the incoming cover band transport run 40 on the right at the rated speed.

Figure 2C:
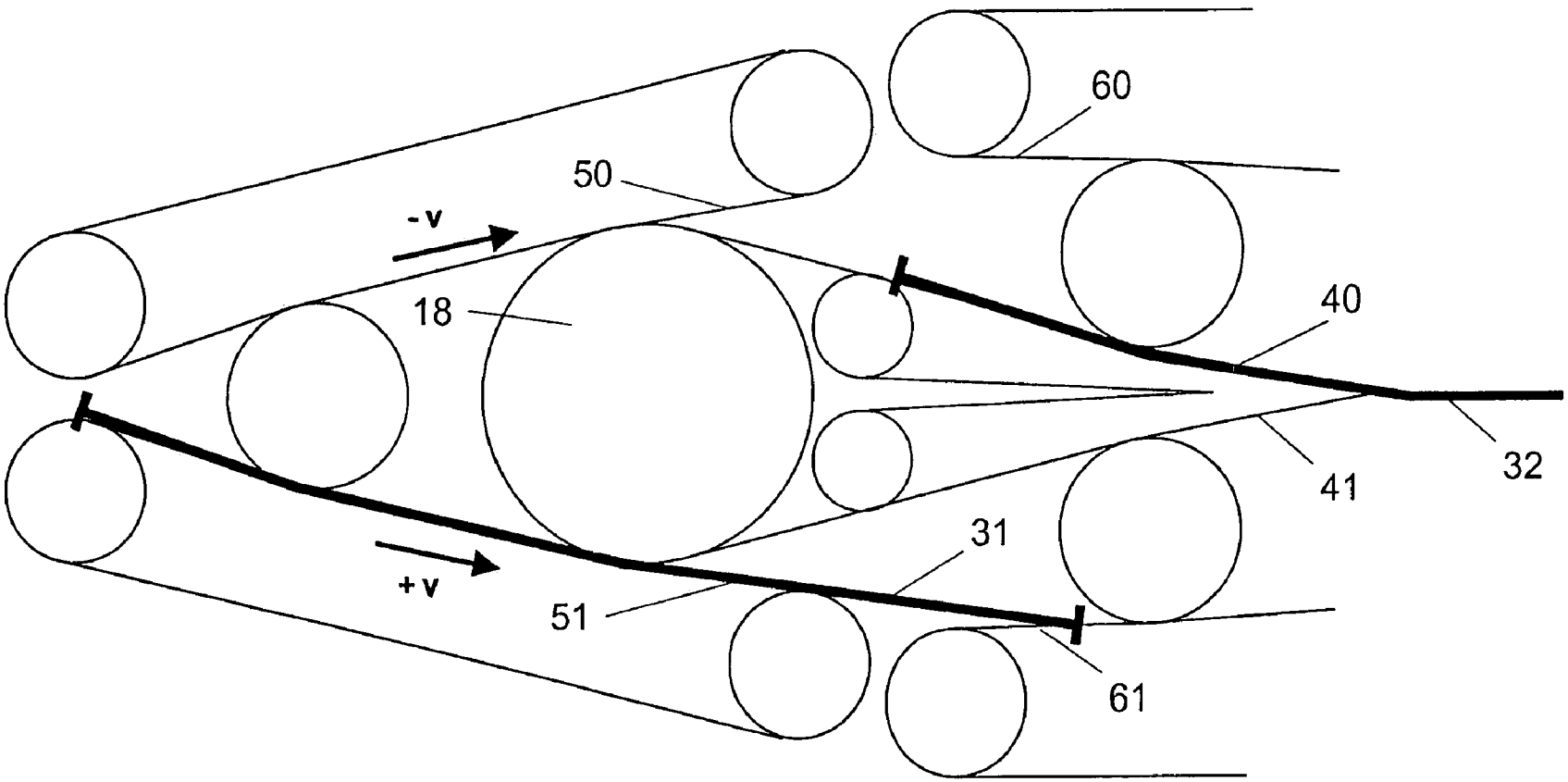

FIG. 2*c* shows a subsequent point in time at which the drive roller 18 has been accelerated up to its rated speed and thus the second letter 31 can move at the rated speed into the removal cover band transport means 61 running at this speed. In the mean time the third letter 32 has arrived at the end of the introducing cover band transport run 40 and can then be accepted by the subsequent conveyor run 50 running at this speed.

Figure 2D:
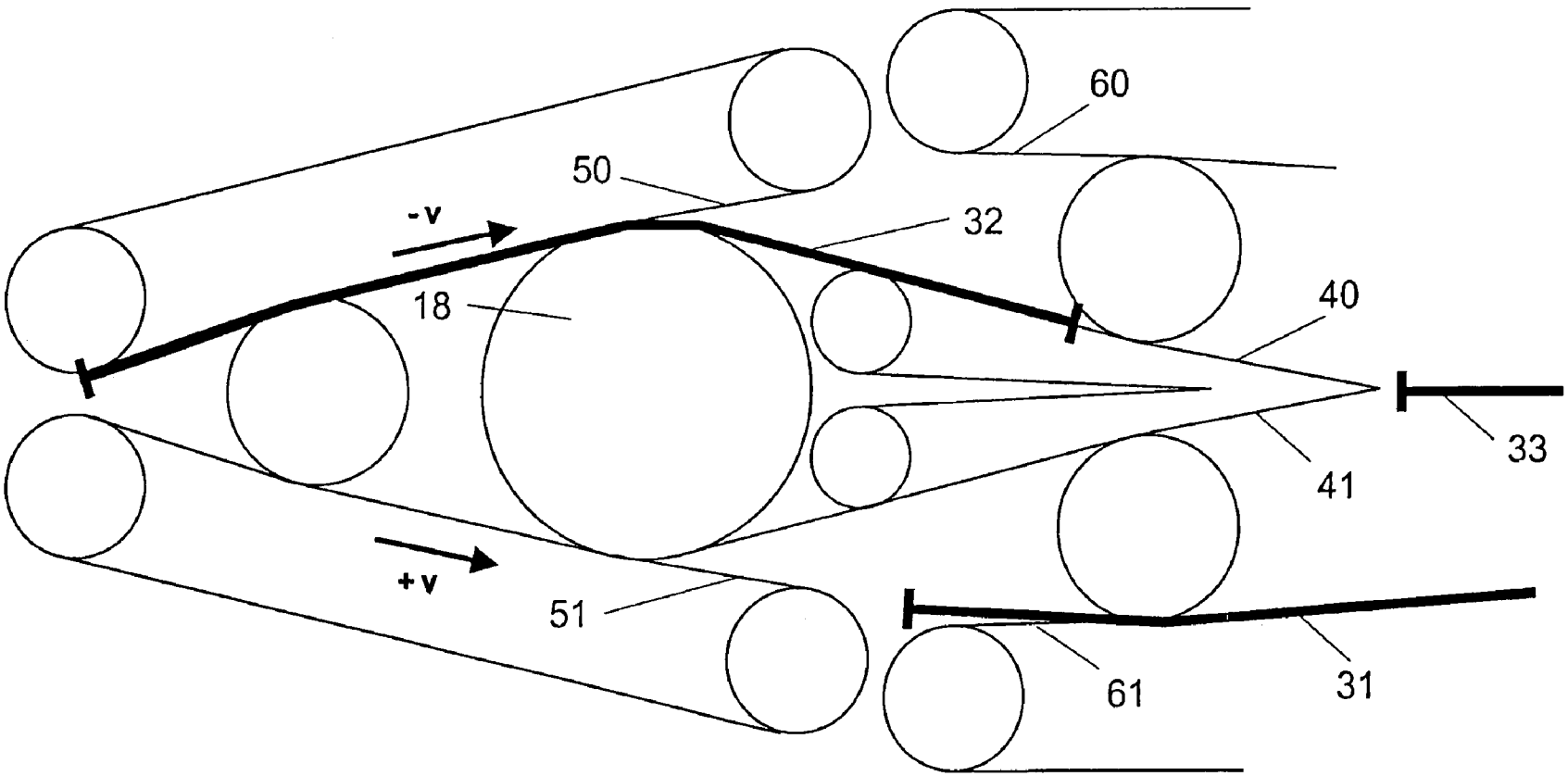

At the point in time shown in FIG. 2*d* the second letter 31 has in the meantime left the conveyor run 51 and the third letter 32 has just left the last clamping position of the cover band transport run 40, so that the braking process for the conveyor run 50 can be started by the drive drum 18. In the mean time the fourth letter 33 of the flow of letters has reached the junction and the further execution sequence then occurs as described for FIG. 2*a-c*, but on the other side of the drive drum 18 in each case.

The invention claimed is:

1. A device for reversal of direction of planar letters in letter sorting systems, comprising:

an introducing cover band conveyor means having two endless circulating belts between which the letters are transported clamped one after another, a junction for separating the letters alternately onto two cover band transport runs running at an acute angle to each other, each with two endless belts, to each of which a controlled and reversibly-driven conveyor run, in which the letters are also transported clamped, is connected, wherein both conveyor runs are driven by a drive roller arranged between them and the letters are carried at such an enfolding angle around the drive roller that the letters taking into account the frictional forces, are braked and accelerated substantially without slipping, wherein each conveyor run is configured so that it carries the letters, when transporting them back, at an acute angle to the relevant introducing cover band transport run into a removing cover band transport means with two endless belts, wherein a drive control of the drive roller is configured so that, on entry of a subsequent postal letter into one of the conveyor runs, back-transported postal letter is already accelerated to its rated speed, braking is only started when a rear edge of the subsequent postal letter has left the cover band transport run and the preceding letter is no longer clamped in the controlled and reversibly-driven conveyor run, and wherein the letters in the device are carried in the device by friction at all times.

2. The device of claim 1, wherein the two removing cover band transport means removing the letters during back-transport are routed to one confluence with one output.

3. The device of claim 1, wherein ends of the controlled and reversibly-driven conveyor runs are positioned far enough away from each other for letters to be transported onwards without their direction being reversed to be able to be transported without hindrance to a subsequent third removing cover band transport means.

4. The device of claim 1, wherein the two controlled and reversibly-driven conveyor runs each have an outer, endless cover band, which is routed between two deflection rollers and a common inner cover band, which is routed via the drive roller and a further deflection roller.

5. The device of claim 1, wherein the two controlled and reversibly-driven conveyor runs each have an outer, endless cover band, which is routed over two deflection rollers, and the drive roller.

6. The device of claim 5, wherein for clamping the letters in both conveyor runs another non-driven pressure roller is provided.

7. The device of claim 1, wherein as an outer endless band in each said cover band transport run following the junction and as the inner endless belt of the assigned removing cover band transport means for back transport, only one driven circulating endless belt guided by rollers is provided.

8. The device of claim 1, wherein clamping distances defined by points of contact of the rollers with the belts are smaller than a shortest letter.

9. The device of claim 1, wherein light barriers are provided as detection means for edges of letters.

* * * * *